US012017815B2

(12) United States Patent
Grubbs

(10) Patent No.: US 12,017,815 B2
(45) Date of Patent: Jun. 25, 2024

(54) MANUALLY OPERATED STRETCH WRAP DEVICE

(71) Applicant: Alliance Plastics, LLC, Rock Hill, SC (US)

(72) Inventor: Ronald Grubbs, Charlotte, NC (US)

( * ) Notice: Subject to any disclaimer, the term of this patent is extended or adjusted under 35 U.S.C. 154(b) by 21 days.

(21) Appl. No.: 17/574,197

(22) Filed: Jan. 12, 2022

(65) Prior Publication Data

US 2022/0135270 A1 May 5, 2022

Related U.S. Application Data

(62) Division of application No. 14/873,359, filed on Oct. 2, 2015, now abandoned.

(51) Int. Cl.

| | |
|---|---|
| ***B65B 7/08*** | (2006.01) |
| ***B65B 11/02*** | (2006.01) |
| ***B65B 67/08*** | (2006.01) |
| ***B65H 16/00*** | (2006.01) |

(52) U.S. Cl.

CPC ..... *B65B 67/085* (2013.01); *B65B 11/02* (2013.01); *B65H 16/005* (2013.01)

(58) Field of Classification Search

CPC ..... B65B 67/085; B65H 16/005

USPC ..... 53/441, 556, 461, 523, 528, 203, 218, 53/219

See application file for complete search history.

(56) References Cited

U.S. PATENT DOCUMENTS

| | | | | |
|---|---|---|---|---|
| 4,172,567 | A * | 10/1979 | Post | B65H 75/406 242/399 |
| 4,530,473 | A * | 7/1985 | Parry | B65B 67/085 242/422.4 |
| 5,203,517 | A * | 4/1993 | Parry | B65B 67/085 242/422.4 |
| 7,437,863 | B2 * | 10/2008 | Moser | B65B 67/08 53/210 |
| 2012/0153063 | A1 * | 6/2012 | Furuichi | B65B 67/085 242/588.2 |

* cited by examiner

*Primary Examiner* — Praachi M Pathak

(74) *Attorney, Agent, or Firm* — Blake E. Vande Garde; AVEK IP, LLC

(57) ABSTRACT

A manually operated stretch wrap device comprising: a rigid, cylindrical support member comprising: a proximal section adapted to support a stretch wrap roll, and to facilitate rotational dispensing of the stretch wrap from said roll, a distal section adapted to support a stretch wrap roll, and to facilitate rotational dispensing of the stretch wrap from said roll, and a center section adapted to be held by a person using one hand and adapted to facilitate rotational dispensing of the stretch wrap from the proximal and distal sections of the device.

8 Claims, 5 Drawing Sheets

MANUALLY OPERATED STRETCH WRAP DEVICE

RELATED CASES

This is a divisional application of U.S. patent application Ser. No. 14/873,359 filed on Oct. 2, 2015. The disclosure of that application is expressly incorporated herein by reference.

FIELD OF THE INVENTION

A manually operated stretch wrap device designed to assist an individual with wrapping one or more desired materials or objects in stretch wrap is disclosed herein below.

BACKGROUND OF THE INVENTION

Stretched film is commonly used on goods shipped on palettes or in assembled packages to keep the goods from shifting, falling or otherwise being damaged during transport. The stretched film produces a tight wrap on the load and provides basic protection from the elements. Both manually operated and fully automated systems exist to wrap plastic film around goods.

Manually operated stretch wrap devices designed to be operated using only one hand are known for employing a single roll of stretch wrap. Unfortunately, single roll of shrink wrap is an inefficient use of both time and energy. The ability to use more than a single roll of stretch wrap would allow an individual both the use of one hand to steady and/or manipulate the goods being wrapped and to wrap the goods in a shorter amount of time. Additionally, many types of goods must be secured or contained on a load while still allowing for proper ventilation. Items such as produce, frozen goods and anything travelling from a hot/warm environment to a colder environment must be permitted to "breathe" in order to avoid moisture condensation (canned goods, jams, jellies, yogurt, etc.)

Accordingly, there is a need for an improved manually operated stretch wrap device which incorporates twin rolls of stretch wrap, which allow for a user to quickly complete the task of wrapping a shipment using only one hand while maintaining ventilation of a shipment as desired.

SUMMARY OF THE INVENTION

A manually operated stretch wrap device comprising: a rigid, cylindrical support member comprising: a proximal section adapted to support a stretch wrap roll, and to facilitate rotational dispensing of the stretch wrap from said roll, a distal section adapted to support a stretch wrap roll, and to facilitate rotational dispensing of the stretch wrap from said roll, and a center section adapted to be held by a person using one hand and adapted to facilitate rotational dispensing of the stretch wrap from the proximal and distal sections of the device.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
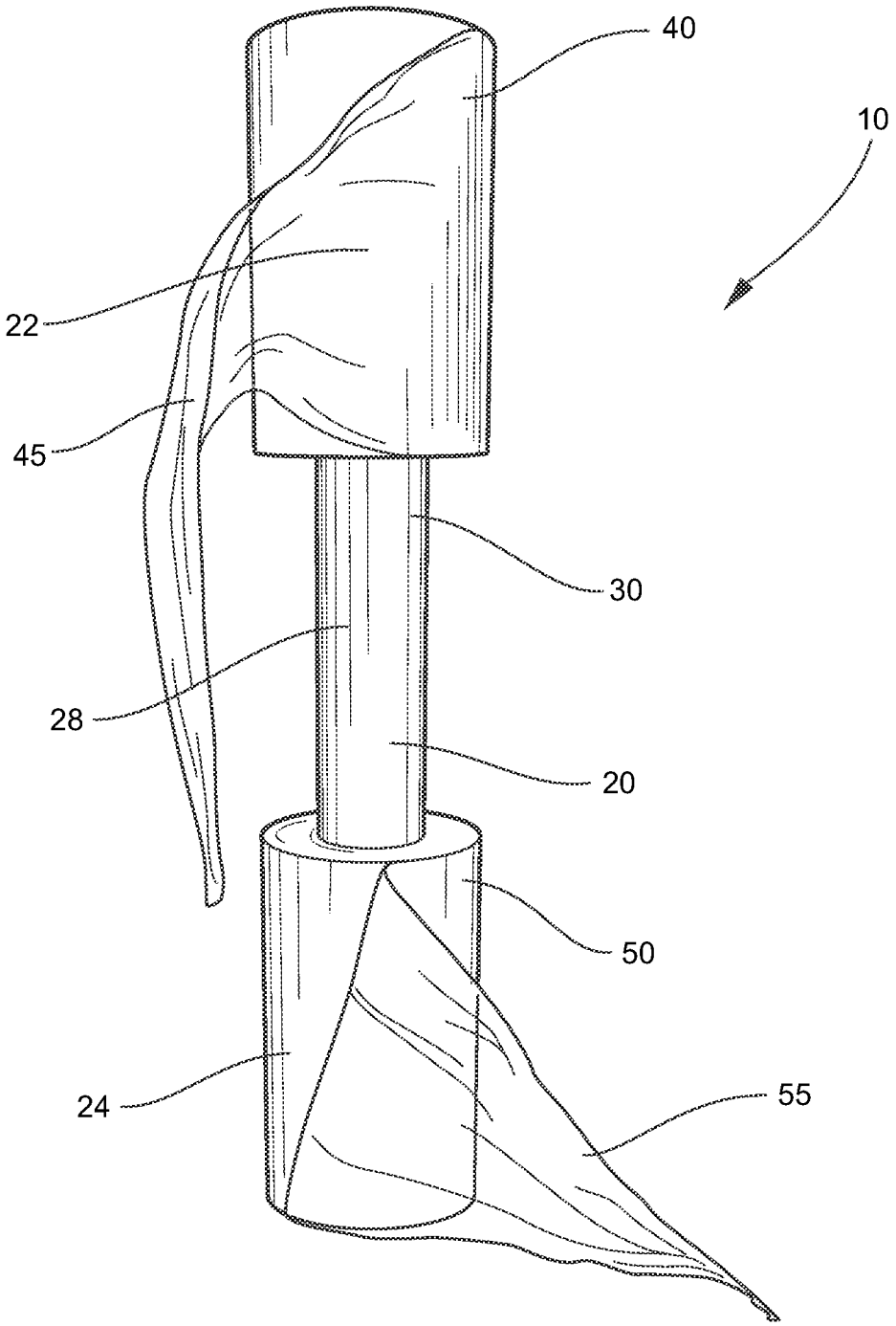
FIG. 1 is a side view of one embodiment of the manual stretch-wrap device of the present invention.
Figure 2:
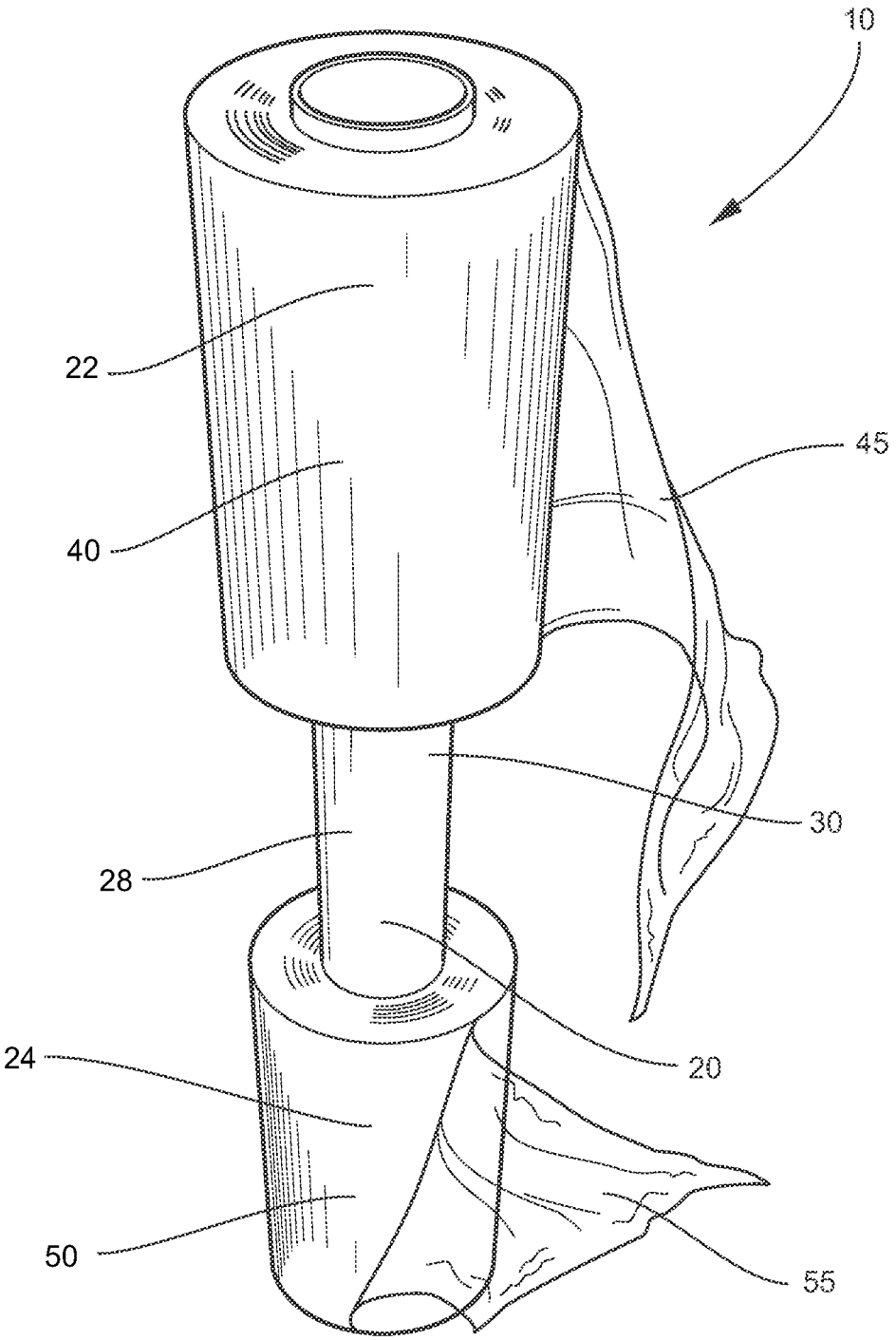
FIG. 2 is a perspective view of one embodiment of the manual stretch-wrap device of the present invention.
Figure 3:
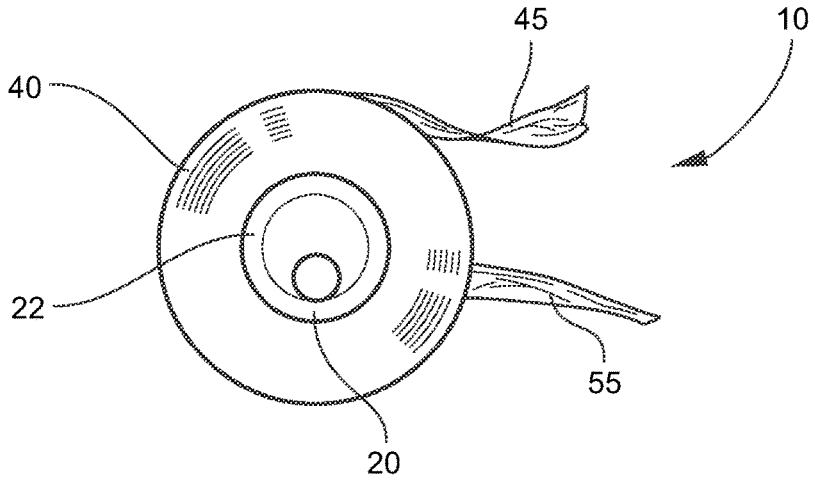
FIG. 3 is a top view of one embodiment of the manual stretch-wrap device of the present invention.
Figure 4:
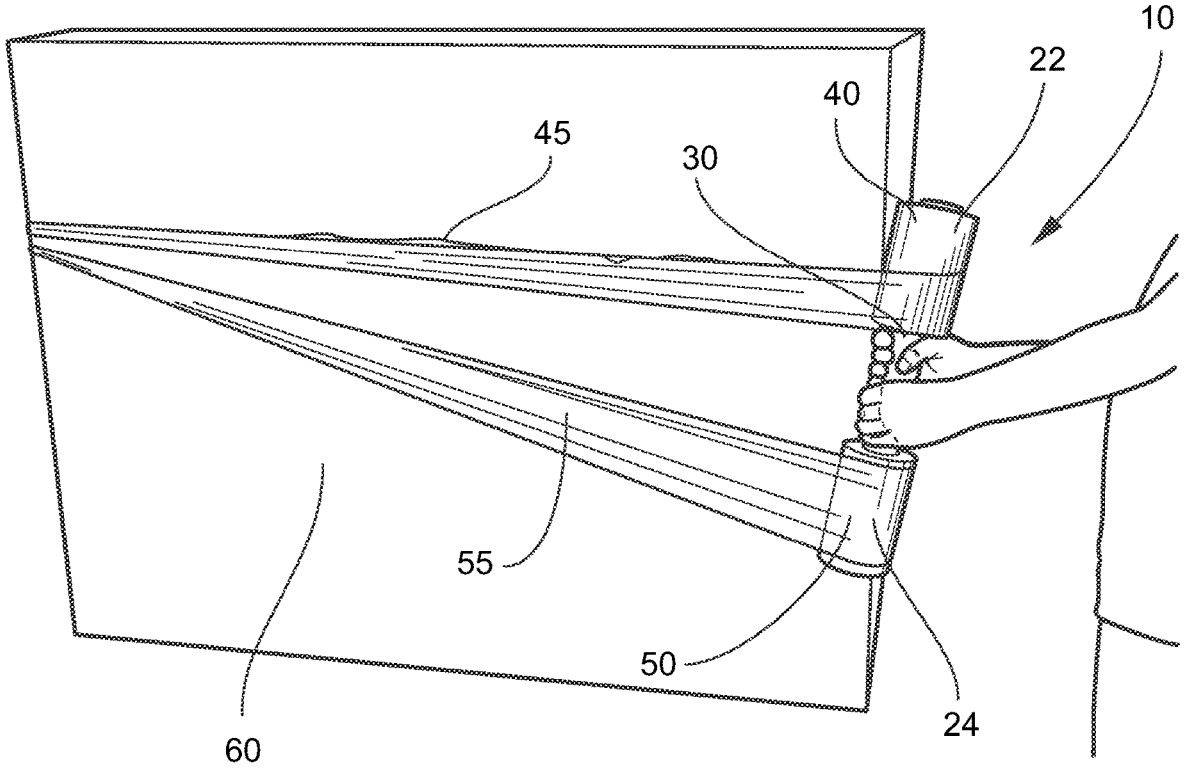
FIG. 4 is a view of one embodiment of the manual stretch-wrap device of the present invention in use.
Figure 5:
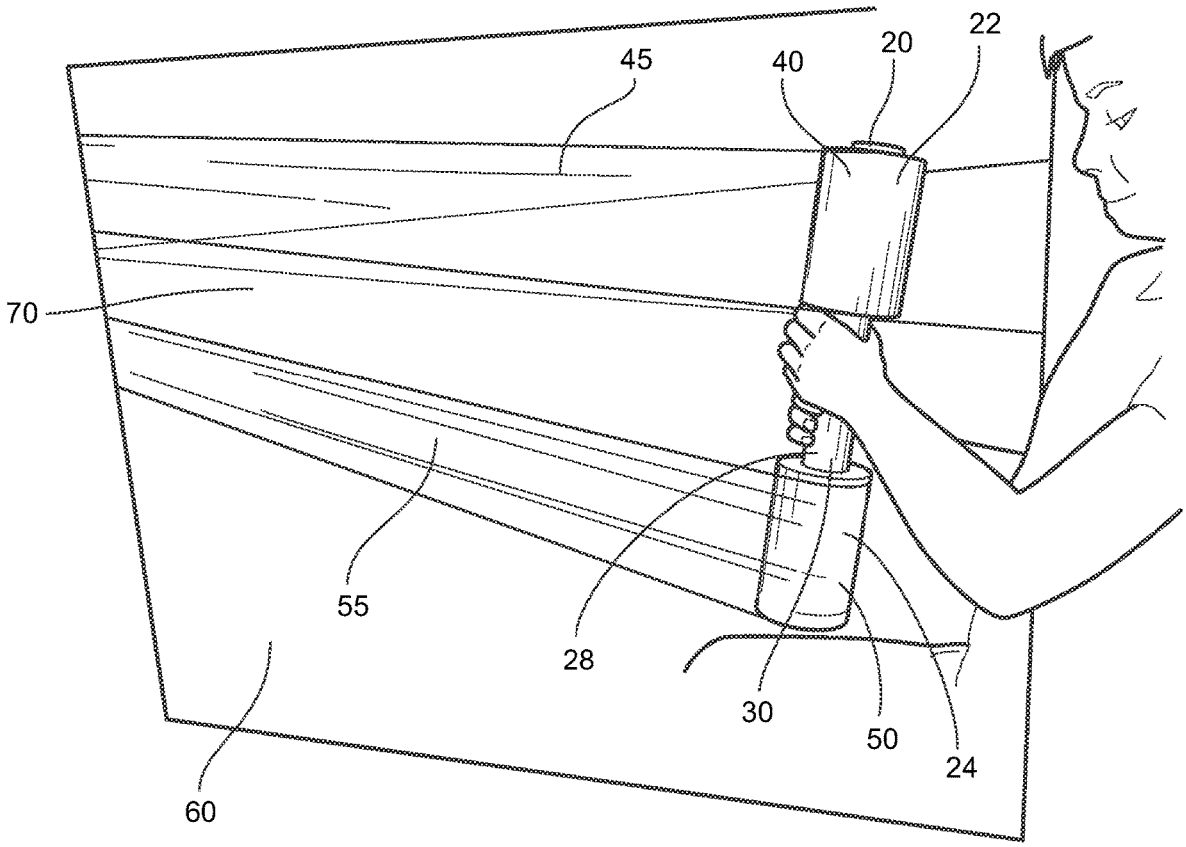
FIG. 5 is a view of one embodiment of the manual stretch-wrap device of the present invention in use.

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Looking now to the figures, where like numerals indicate like elements, the instant invention discloses a manually operated stretch wrap device 10 comprising: a rigid, cylindrical support member 20 comprising: a proximal section 22 adapted to support a first stretch wrap roll 40, and to facilitate rotational dispensing of the stretch wrap 45 from the roll, a distal section 24 adapted to support a second stretch wrap roll 50, and to facilitate rotational dispensing of the stretch wrap 55 from the roll and a center section 28 adapted to be held by a person using one hand and adapted to facilitate rotational dispensing of the stretch wrap 45, 55 from the proximal 22 and distal sections 24 of the device.

The manually operated stretch wrap device 10 is a device which dispenses a material known in the industry as plastic stretch film, stretch wrap, shrink wrap, stretch film, etc. The material is a highly stretchable plastic film, which may be wrapped around items in a variety of manners in order to secure those items in a desired position and/or location. The material is often a linear low-density polyethylene or LLDPE which is produced by the copolymerization of ethylene with alpha olefins. Other types of polyethylene and polyvinyl chloride may also be used to produce the film. The film may be produced by any manner known in the art. In one embodiment of the instant invention, the amount of stretch imparted on the stretch wrap is controlled solely by the individual operating the manually operated stretch wrap device 10.

As stated above, the cylindrical support member 20 is divided into 3 sections. At one end is the proximal section 22, and at the opposite end is the distal section 24, with the center section 28, located between the proximal and distal sections. The proximal section 22 and distal section 24, are designed to support stretch wrap roles 40, 50, ranging in length from 5 to 45 cm. in one embodiment of the instant invention, the proximal section 22 and the distal section 24 are removably attached to the center section 28. The proximal and distal sections may be removable and interchangeable by any means known in the art which include, but is not limited to, threaded rods and nuts/caps, spring retaining clips, or any combination thereof. In one embodiment of the instant invention, the center section 28 further comprises a rotatable handle 30 which allows the proximal 22, center, 28 and distal 24 sections to rotate freely while the handle 30 remain stationary in a user's hand. In another embodiment, a rotatable handle is secured to the center section 28 using one or more bearings. In still another embodiment, a stretch wrap device 10 may further comprise the stretch wrap roles 40, 50, being rotatably mounted or secured on the proximal section 22 and distal section 24 using one or more bearings which allow the proximal and distal sections to rotate freely while the handle 30 remain stationary in the user's hand.

In one embodiment of the instant invention, the stretch wrap device 10 is recyclable. In another embodiment of the instant invention, the stretch wrap device 10 is biodegradable. In yet another embodiment of the instant invention, the first stretch wrap roll 40 and the second stretch wrap roll 50 are both secured to the device in order to rotatably dispense stretch wrap from each role in a clockwise direction. In still another embodiment of the instant invention, the first stretch wrap roll 40 and the second stretch wrap roll 50 are both secured to the device in order to rotatably dispense stretch wrap from each role in a counter-clockwise direction. In yet another embodiment of the instant invention, the first stretch wrap roll 40 is secured to the device in order to rotatably dispense stretch wrap in a counter-clockwise direction and the second stretch wrap roll 50 is secured to the device in order to rotatably dispense stretch wrap in a clockwise direction. The ability to control the individual direction of each stretch wrap roll provides greater control to the person dispensing the wrap to facilitate proper ventilation of the goods being secured.

The instant invention also includes a method of using a manually operated stretch wrap device 10 to secure goods, 60 in a desired configuration and location comprising the steps of:

a. providing a manually operated stretch wrap device 10 comprising:
   a rigid, cylindrical support member 20 comprising: a proximal section 22 adapted to support a first stretch wrap roll 40, and to facilitate rotational dispensing of the stretch wrap 45 from the roll, a distal section 24 adapted to support a second stretch wrap roll 50, and to facilitate rotational dispensing of the stretch wrap 55 from the roll and a center section 28 adapted to be held by a person using one hand and adapted to facilitate rotational dispensing of the stretch wrap 45, 55 from the proximal 40 and distal 50 sections of the device 10;
b. preparing the device for wrapping the goods 60 with the stretch wrap 45, 55;
c. placing a portion of the stretch wrap 45, 55 from each roll 40, 50 against the goods 60 while maintaining the approximate distance 70 between each roll that the handle 30 provides on the device to allow for a desired level of ventilation (i.e. ventilation gaps 75) to be maintained;
d. wrapping the goods 60 with the stretch wrap 45, 55 by rotationally dispensing the stretch wrap from the first 40 and second 50 stretch wrap rolls; and
e. cutting the stretch wrap 45, 55 at the rolls to stop dispensing the stretch wrap.

Figure 6:
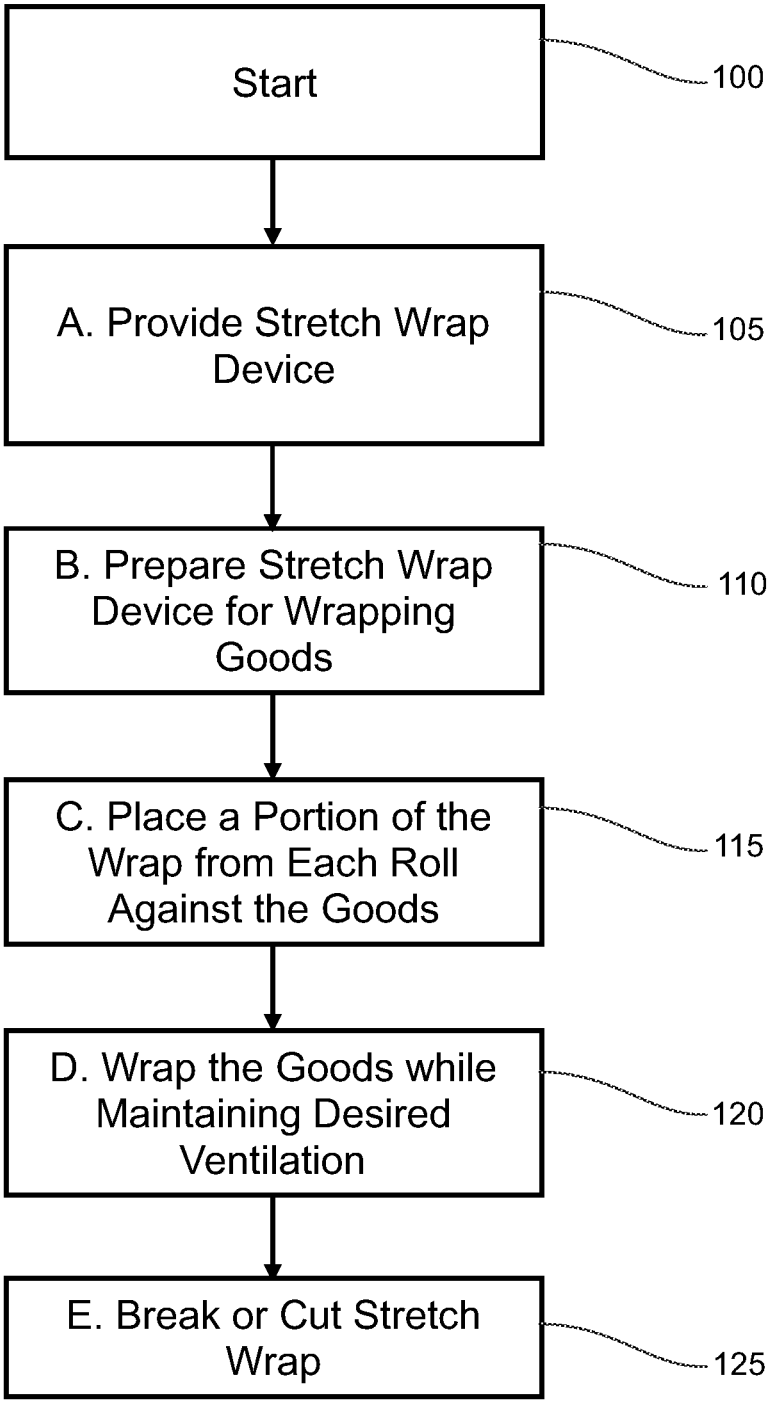
FIG. 6 is a flow chart detailing a method of wrapping goods with the instant invention.

A method of wrapping and securing goods is also detailed in FIG. 6. The process begins at step 100. Step 105 describes providing a manually operated stretch wrap device as described above. At step 110, the device is prepared for wrapping the goods. Preparation may include loading one or two stretch wrap roles onto the device, peeling a loose end of stretch wrap from each of the 2 stretch wrap roles, ensuring that the stretch wrap roles are both unwrapping properly, ensuring that each stretch wrap roll is rotationally dispensing stretch wrap in a desired direction (i.e., clockwise, counterclockwise, or a combination thereof).

Looking now to step 115, a portion of the wrap from each role is placed against the goods. Step 120 involves wrapping the goods while maintaining a desired level of ventilation of those goods. This can be achieved by varying the height at which the stretch wrap device is held while wrapping the goods. Step 125 involves breaking or cutting the stretch wrap at each role after the goods of been secured.

Any method described herein may incorporate any design element contained within this application and any other document/application incorporated by reference herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention may be embodied in other forms without departing from the spirit and the essential attributes thereof, and, accordingly, reference should be made to the appended claims, rather than to the foregoing specification, as indicating the scope of the invention. The invention illustratively discloses herein suitably may be practiced in the absence of any element which is not specifically disclosed herein.

I claim:

1. A manually operated stretch wrap device consisting of:
a rigid, cylindrical support member consisting of:
   a proximal section adapted to support a first stretch wrap roll, and to facilitate rotational dispensing of the stretch wrap from said roll;

a distal section adapted to support a second stretch wrap roll, and to facilitate rotational dispensing of the stretch wrap from said roll; and a center section adapted to be held by a person using one hand and adapted to facilitate rotational dispensing of the stretch wrap from the proximal and distal sections of the device.

2. The stretch wrap device of claim 1 wherein said proximal section and said distal section support stretch wrap rolls ranging in length from 7 cm to 45 cm.

3. The stretch wrap device of claim 1 wherein said proximal section and said distal section are removably attached to the center section.

4. A manually operated stretch wrap device consisting of:

a rigid, cylindrical support member consisting of:

a proximal section adapted to support a first stretch wrap roll, and to facilitate rotational dispensing of the stretch wrap from said roll;

a distal section adapted to support a second stretch wrap roll, and to facilitate rotational dispensing of the stretch wrap from said roll; and a center section separating the proximal and distal sections;

a rotatable handle rotatably secured around the center section;

wherein the rotatable handle allows the proximal section, the distal section and the center section to rotate freely while the handle remains stationary; and wherein the rotatable handle is designed to be gripped by a person using one hand and facilitate rotational dispensing of the stretch wrap from the proximal and distal sections of the device.

5. The method of claim 4 wherein the proximal section and said distal section of said stretch wrap device each support stretch wrap rolls ranging in length from 7 cm to 45 cm.

6. The stretch wrap device of claim 4 wherein said proximal section and said distal section of said stretch wrap device are each removably attached to the center section.

7. The stretch wrap device of claim 4 wherein said rotatable handle being secured to said center section with one or more roller bearings.

8. The stretch wrap device of claim 4 wherein the rotatable handle is secured to the center section using one or more bearings.

* * * * *